US006201470B1

(12) United States Patent
Withington

(10) Patent No.: US 6,201,470 B1
(45) Date of Patent: Mar. 13, 2001

(54) LOCATING DEVICES

(75) Inventor: Deborah Jane Withington, Harrogate (GB)

(73) Assignee: Sound Alert Limited, Leeds (GB)

( * ) Notice: Subject to any disclaimer, the term of this patent is extended or adjusted under 35 U.S.C. 154(b) by 0 days.

(21) Appl. No.: 08/983,276

(22) PCT Filed: Jun. 17, 1996

(86) PCT No.: PCT/GB96/01420

§ 371 Date: Jan. 7, 1998

§ 102(e) Date: Jan. 7, 1998

(87) PCT Pub. No.: WO97/03424

PCT Pub. Date: Jan. 30, 1997

(30) Foreign Application Priority Data

Jul. 7, 1995 (GB) ..... 9513887
Oct. 17, 1995 (GB) ..... 9521203

(51) Int. Cl.[7] ..... G08B 3/10

(52) U.S. Cl. ..... 340/384.7; 340/326; 340/309.15; 340/825.36; 340/825.49

(58) Field of Search ..... 340/384.7, 326, 340/309.15, 321, 539, 568.1, 825.36, 825.49

(56) References Cited

U.S. PATENT DOCUMENTS

| | | | | |
|---|---|---|---|---|
| 4,086,589 | | 4/1978 | Cieslak | 340/384.7 |
| 4,952,931 | * | 8/1990 | Serageldin et al. | 340/902 |
| 5,266,921 | * | 11/1993 | Wilson | 340/384.73 X |
| 5,898,363 | * | 4/1999 | Altilio | 340/384.1 |
| 5,949,328 | * | 9/1999 | Latty | 340/326 |

FOREIGN PATENT DOCUMENTS

| | | |
|---|---|---|
| 0 100 650 | 2/1984 | (EP) . |
| 2 706 657 | 12/1994 | (FR) . |
| 90/11585 | 4/1990 | (WO) . |
| 9500935 | 1/1995 | (WO) . |

* cited by examiner

*Primary Examiner*—Daryl Pope
(74) *Attorney, Agent, or Firm*—Jacobson, Price, Holman & Stern, PLLC

(57) ABSTRACT

A device usable in a plurality of environments such as in buildings, transport vehicles, pedestrian aids and sirens for producing a locating sound of broad band noise. The broad band noise is formed from frequencies emitted simultaneously within a human hearing range. An alerting sound may also be emitted.

30 Claims, 2 Drawing Sheets

LOCATING DEVICES

FIELD OF INVENTION

This invention relates to signal patterns for use in locating devices; locating devices; and systems incorporating locating devices for use in, particularly but not exclusively, buildings, domestic or commercial or large transport vehicles such as aircraft, liners or the like, or even in pedestrian aids such as road crossing devices, and indicating devices such as audible warning devices or sirens and, particularly but not exclusively, vehicle sirens, or monitors such as security monitors.

In instances of emergency, or even in instances where it is simply necessary to direct individuals to a predetermined location, audio and/or visual means may be provided in order to alert individuals to a given situation and/or to indicate a direction in which individuals must travel in response to said situation. For example, in the instance where there is danger or hazard because of a domestic or commercial fire or in the instance where there is a leak either chemical or physical, such as in the form as radiation, it may be necessary to firstly alert individuals to the potential danger or hazard and secondly to ensure that the individuals can reach a safe environment. To this end, domestic dwellings or indeed any of the aforementioned constructions, may be provided with smoke detectors and commercial buildings may be provided with smoke/chemical/radiation detectors and a combination of signs indicating a safe point of exit. Activation of the detectors typically result in a siren sounding which simply alerts individuals to potential danger and then individuals, either through knowledge of their own domestic environment, or through following a number of signs are expected to find a safe point of exit.

Unfortunately, where there is a fire or a chemical leak visual signs can be used obscured from view and/or an individual's ability to see such signs can be impaired because of the effects of the smoke/chemical on vision. It therefore follows that the provision of a conventional alarm with or-without signs is an insufficient safeguard to ensure that individuals can exit a building.

In addition to the above, in instances of danger or hazard, it may be desirable for skilled personnel such as fire fighters or paramedics, to enter a building and in these situations it would be advantageous if a means were provided for helping these people to navigate once inside the building. Furthermore, it would also be extremely advantageous to provide a means which enables skilled personnel in the building to locate other skilled personnel. Such means do not currently exist.

In other instances of emergency for example, where a vehicle's siren is sounding individuals may need to locate the siren and thus the vehicle in order to take evasive action. Whilst it is true to say that individuals may have learnt to recognise and respond to the sound patterns generated by vehicles sirens such as those generated by police vehicles, ambulances or fire tenders it is not true to say that individuals can easily locate such vehicles, especially whilst undertaking another task e.g. whilst driving, and so be able to respond. This can be extremely problematical where an emergency service vehicle needs to speed safely to the site of an incident. It therefore follows that the provision of a siren which simply makes a loud noise, albeit that the pattern of the noise may be distinctive, is not enough to ensure that individuals can respond accordingly.

There are also many other instances where a device which facilitates localization could be used to advantage. For example, a burglar alarm that was also adapted to enable localization would be advantageous; aids for the visually impaired and "earcons" to replace or complement the icons associated with computer software could also be provided with a locating means in accordance with the invention to considerable advantage. It should therefore be apparent that although the invention has been described with reference to the above it has multiple applications and indeed can be used in any situation where it is desirable to provide an audio location device.

It is known that accurate sound localization is one of the most complicated processes performed by the brain. Nethertheless, it is also known that, given appropriate cues, the brain can detect the direction of a sound source up to an accuracy of 2°. This high degree of accuracy is only possible when the sound is complex and made up of a majority of frequencies in our hearing range. The brain can not locate, with any degree of spatial precision, simple pure tones. Given this knowledge it is remarkable that for decades alerting sounds in common usage, in every and any situation, for which directionality would seem an essential characteristic, are not complex enough to permit accurate localization. In other words devices which are supposed to help us localise sounds do not possess the acoustic complexity necessary for accurate localization.

OBJECTS OF THE INVENTION AND BRIEF SUMMARY

It is therefore an object of the invention to provide an alarm, aid or earcon which enables an individual to locate a given object and take appropriate action.

According to a first aspect of the invention there is therefore provided a device which is adapted to emit either simultaneously and/or successively a locating sound comprising a majority of frequencies in the human hearing range; and an alerting sound comprising a minority of frequencies within the human hearing range.

In a preferred embodiment of the invention the said locating sound comprises either broadband noise or white noise or flat random noise. More preferably selected components of said noise are amplified or attenuated having regard to the properties of a speaker of the device and/or the absorbing properties of the environment in which a listener is located and/or the auditory, either existing or expected, environment of a listener.

For example, an emergency vehicle device is ideally adapted such that frequencies above 4 KHz are amplified either by selectively amplifying frequencies of 4 KHz or more and/or by selectively attenuating frequencies of less than 4 KHz such that vehicle drivers hear an optimum locating sound, which is not deleteriously affected by the structure of the driver's vehicle and so has a relatively even spectral quality.

In a yet further preferred embodiment of the invention the said alerting sound comprises any suitable alerting or alarming noise either of a conventional nature or otherwise.

More preferably still said locating and alerting sounds are emitted successively and ideally there is a predetermined interval between same.

More preferably further still said alerting sound comprises a number of bursts of sound either of the same nature and duration or otherwise.

In the instance where the alerting sound comprises bursts of sound the interval between each of said bursts may be identical or different and further more the interval between said bursts and said emission of said locating and alerting sounds may be identical or different.

Preferably at least one of said bursts and more preferably each of said bursts of sound comprises a main fundamental frequency which in a preferred embodiment may be adapted to sweep over a frequency range. The fundamental frequency of each of said bursts may be the same or different so that in one example only of the invention a number of successive bursts of alerting sound are provided prior to and/or during and/or after the emission of a locating sound.

In one embodiment of the invention there is provided a plurality of said devices wherein each device has a different but distinctive second alerting sound. In this embodiment a selected skilled individual such as a fire fighter or paramedic is given one of the distinctive sounding devices and a knowledge of this distinctive sound is conveyed to other skilled personnel prior to the said individual entering a building. In this way a number of skilled personnel can be provided with distinctive audio signals that will enable other individuals, within the same building, to firstly identify who, such as which class of personnel, is in the building, and secondly, where each of these individuals is located.

The time intervals and the frequencies of said locating and alerting sounds and any intervals therebetween or therein are not crucial to the working of the invention save only that an individual must be able to locate a preselected device emitting said sounds and be alerted to the need to do so or vice versa.

In a further aspect, the invention also relates to a locating device which is adapted to emit locating sound comprising a majority of frequencies in the human hearing range at least one of which is selected so as to be amplified or attenuated.

Ideally a plurality of such frequencies are selected as above so that said device emits sound comprising at least one, and ideally a number of amplified or attenuated frequencies.

In this preferred aspect of the invention said amplification or attenuation is performed having regard to the sound absorbing properties of the environment or medium through which the sound is to travel and/or the auditory, existing or expected, environment through which the sound is to travel with a view to ensuring that a listener hears an optimum locating sound and is thus able to locate the device.

More specific embodiments of the invention will now be provided by way of example only in order that the reader may gain a clearer understanding of the invention, however it is not intended that the scope of the invention is to be limited in accordance with the following examples.

In one example of the invention said locating sound may be emitted for an interval between 1 ms and continuity however, in another embodiment of the invention we prefer to emit the locating sound for between 10 ms to 2 secs and ideally between 10 ms to 500 ms, more preferably between 150 ms and 300 ms or more preferably further still for a duration of approximately 200 ms.

The locating sound may be ramped so that, for example, a 5 ms onset time is followed by 190 ms of sound emission and a 5 ms offset time. Although we prefer a locating sound having the aforementioned ramped profile obvious alterations may be provided without deviating from the scope of the invention. We have found that ramping, advantageously, avoids a ringing effect.

As an example only of locating sound broadband or white noise in a range between 40 Hz and 20 kHz may be provided although in one embodiment we prefer to use 40 Hz to 16 kHz. However, it is not intended that the invention should be limited to these frequencies which are merely provided by way of exemplification, rather any sound of sufficient complexity which enables localization can be used.

In so far as the alerting sound is concerned the duration may be between 1 ms and an interval designed to attract the attention of an individual. In one embodiment of our invention we prefer to use a time interval of between 1 ms and 100 secs and ideally we prefer an interval between 1 ms and 200 ms, and further we prefer our alerting sound to comprise a number of sound bursts, we prefer each burst to last for a duration of between 1 ms and 100 ms and ideally between 20 ms and 30 ms and to be separated by an interval of up to 50 ms and ideally of 10 ms. The number and nature of bursts may be selected according to a user's requirements, for example we have found that a short interburst interval provides for an alerting sound of greater perceived urgency.

In some instances we prefer the alerting sound to also be ramped, again in order to avoid ringing and a startled response.

We prefer the nature of the alerting sound to comprise a fundamental frequency, we have used a frequency between 100 Hz to 3000 Hz and ideally we prefer the frequency to be swept within a range between 100 Hz to 2000 Hz and ideally between 400 Hz to 1200 Hz and more preferably further still a frequency of approximately 500 Hz.

The fundamental frequency may be swept between a fundamental start frequency and a fundamental finish frequency over the duration of the signal burst, the sweep commencing at the fundamental start frequency at the beginning of the signal burst and terminating at the fundamental finish frequency at the end of the signal burst.

Suitably, the fundamental frequency is swept between the fundamental start frequency and the fundamental finish frequency in a substantially linear manner.

The signal burst preferably comprises at least a first main frequency, a second main frequency and a third main frequency. The first, second and third main frequencies may each be swept during the duration of the signal burst.

The first, second and third main frequencies may be swept in a substantially linear manner between the start and the end of the signal burst duration.

The first main frequency is preferably of higher frequency than the fundamental frequency. The second main frequency is of higher frequency than the fundamental and of higher frequency than the first main frequency. The third main frequency is higher than the fundamental, first or second main frequencies at any instance during the sound burst.

A said main frequency may comprise a harmonic of the first frequency. A first main frequency may comprise a first at least one harmonic of the fundamental frequency. A second main frequency may comprise a second at least one harmonic of the fundamental frequency. A third main frequency may comprise a third at least one harmonic of the fundamental frequency.

As the fundamental frequency is swept between the fundamental start frequency and the fundamental finish frequency, the first main frequency may be swept between a first start frequency and a first finish frequency. The first start frequency may be a harmonic frequency of the fundamental start frequency. The first finish frequency may be an harmonic frequency of the fundamental finish frequency.

The second and third main frequencies may be swept between respective second and third start frequencies and second and third frequencies.

By providing a plurality of main frequencies each of which are swept in frequency as the fundamental frequency is swept, and which thereby maintain at any instant during the sound burst, a harmonic relationship between the fundamental frequency and the first, second and third main frequencies, a distinctive burst of sound may be produced which the human brain finds to be alerting.

However, by selecting the first, second and/or third main frequencies to be away from harmonics of the fundamental frequency, a burst of sound can be produced which although unpleasant to the human ear, is equally distinctive and alerting.

Preferably the alerting sound is repeated a plurality of times. Suitably an alert signal burst is produced, and then after a first delay, another alert signal burst is produced and then, after a second delay, another alert signal burst is produced.

Preferably the first and/or second delays each have a duration in the range 5 ms to 100 ms. Optimal delay times have found to be of the order of 10 ms, or of the order of 50 ms.

Preferably after the final alert signal burst, there is a third delay, followed by the noise burst.

When a signal pattern of this type is applied to a siren, or other sound generator, the siren produces three alerting sound bursts, repeated in series, followed by a locating sound burst. This may have the effect of initially alerting a hearer to the presence of the siren (the alerting sound burst), and then enabling the hearer to judge the direction of the siren (by listening to the locating sound burst).

The selection of a fundamental frequency can be varied along with the associated harmonics according to a user's requirements.

Moreover, the relative level of each harmonic may be varied to provide an alerting sound of selected timbre.

In yet further preferred embodiments of the invention the said devices are provided with a cut-out means which after a preselected interval of time disables at least the locating sound.

The advantage of this embodiment of the invention is that it ensures that individuals will not travel towards a site of danger but will merely be alerted to the need to take action. Ideally the said interval of time can be adjusted having regard to the nature of the environment in which the device is to be located. For example, in the instance where a fire has occurred and an environment is thought to comprise highly combustible items then the cut-out interval will be short, or at least shorter than an interval selected for an environment where there are known to be no combustible items and where there may also be an escape exit.

Alternatively the cut-out means may be activated once a heat/chemical/radiation detector, or other detector, associated with the device records a preselected level of a corresponding indicator such as smoke, chemicals, radiation etc.

In this preferred embodiment of the invention after a suitable instance in time said cut-out means may also disable the alerting means. In this instance individuals may be advised to travel towards noise and ideally towards locating noise.

Ideally the said device also includes or is associated with a camera or recorder such as, for example, in a security system where an image of an intruder is required and the device thus included means to prompt the intruder to look toward said camera or recorder.

According to a second aspect of the invention there is provided a device further comprising at least first and second devices each adapted to emit at least one, and in totality both of said locating and alerting sounds, and further wherein said device comprises a control means for coordinating the emission of said locating and/or alerting sounds either simultaneously or successively.

The device of the invention may include any of the features either singularly or in combination afore described.

According to a yet third aspect of the invention there is provided a signal pattern comprising a locating and alerting sound in accordance with the invention.

According to a yet fourth aspect of the invention there is provided a siren for an emergency vehicle, wherein the siren is adapted to emit a sound signal comprising; an alerting sound, and a locating sound phase.

Ideally the alerting sound comprises a plurality of sound bursts, each sound burst comprising a fundamental frequency which is swept over a frequency range within a respective duration of each sound burst.

Ideally the locating sound comprises a majority of frequencies in the human hearing range and ideally broadband noise.

Suitably, the alerting sound phase is of total duration in the range 250 ms to 600 ms, and suitably in the range of 370 ms to 450 ms.

Preferably the locating sound phase is of total duration in the range 10 ms to 500 ms, and suitably around 200 ms to 250 ms.

An emergency vehicle siren producing a generated sound pattern as described above may reduce the number of accidents involving emergency vehicles, and reduce journey times for emergency vehicles, particularly through heavy traffic.

The invention includes a sound generating means arranged to receive an audio signal pattern as described with reference to the above aspects.

The invention includes a signal generating means adapted to produce an audio signal or an audio signal pattern or a sound as described by the above aspects.

The invention includes a signal storage means adapted to carry an audio signal or signal pattern signal as described by the above aspects.

The invention will now be described by way of example only in order that the reader may more readily understand the nature of the device, system, signal pattern and siren in accordance with the invention. However, it is not intended that the scope of the invention should be limited by the following information which is provided by way of exemplification only.

Table 1 describes a first specific alert signal burst;

Table 2 describes a second specific alert signal burst;

Table 3 describes a third specific alert signal burst;

Table 4 describes a fourth specific alert signal burst;

Table 5 describes a fifth specific alert signal burst;

Table 6 describes a sixth specific alert signal burst;

Table 7 describes a seventh specific alert signal burst;

Table 8 describes a eighth specific alert signal burst; and

DETAILED DESCRIPTION OF THE PREFERRED EMBODIMENTS

FIGS. 1 to 5 of the accompanying drawings and Tables 1 to 8 of the accompanying tables describe specific audio signals and audio signal patterns, which may take the form of electronic signals fed to a siren or other like sound generating means. A sound produced by the siren or other sound generating means will contain substantially the same frequency and amplitude components, but rather than in electric signal form, will be in the form of a pressure wave in air, or other like medium which surrounds the siren/signal generating means.

Figure 1:
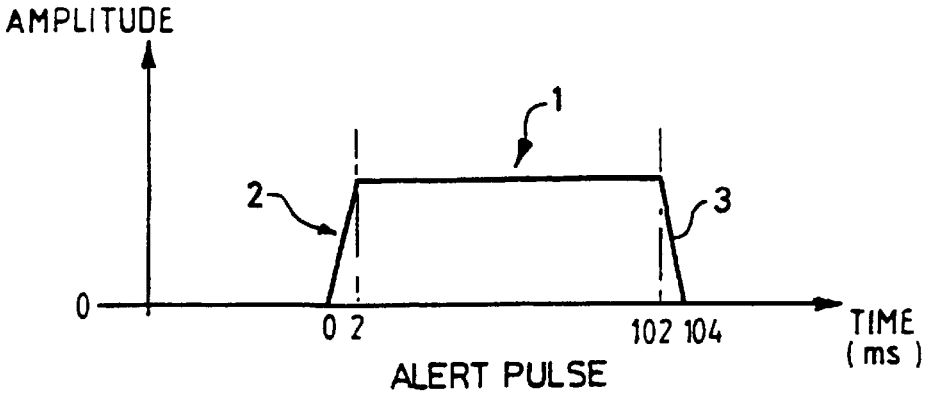
FIG. 1 shows a general representation of an audio signal burst of a first duration, for producing an alerting sound.

Referring to FIG. 1 of the accompanying drawings, there is shown an alert signal burst 1. The alert signal burst 1 comprises a 100 ms burst of audio signal having a 2 ms leading edge, or rise time, 2, in which the signal is raised from a low amplitude level corresponding to an inaudible sound, to a high amplitude level corresponding to a loud audible sound, and a 2 ms falling edge, or fall time, 3 in which the signal falls from its high amplitude level, to its low amplitude level.

The alert signal burst of FIG. 1 is intended to produce a sound which immediately commands the attention of a listener in the vicinity of the siren sound signal generator means.

Figure 2:
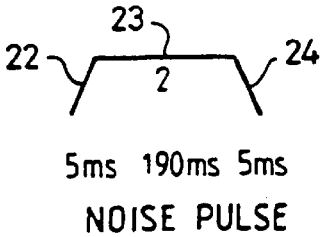
FIG. 2 shows another audio signal burst of a second duration, for producing a locating sound.

Referring to FIG. 2 of the accompanying drawings, there is shown a locating audio signal burst comprising a 190 ms burst of white noise, having a 5 ms leading edge in which the white noise signal or broadband noise in the range 40 Hz to 4 kHz, which undergoes an amplitude transition from a minimum amplitude level in which the signal produces an inaudible, or barely audible sound or no sound to maximum amplitude level, and 5 ms trailing edge, in which the signal undergoes transition from its maximum level to its minimum level.

Figure 3:
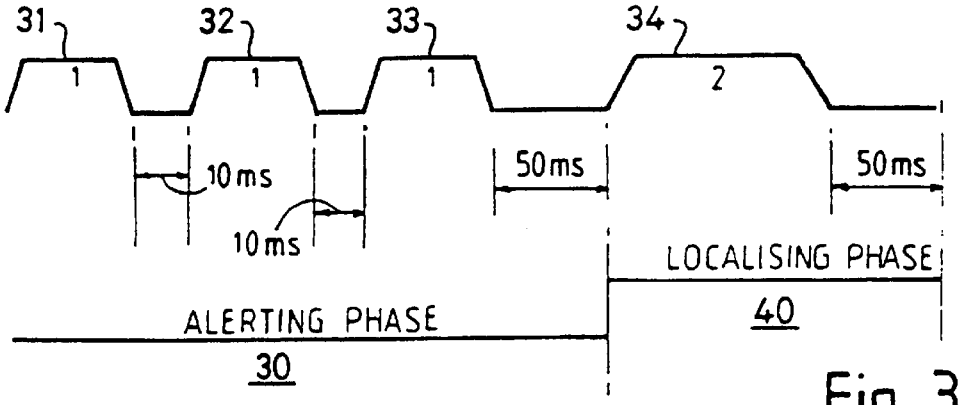
FIG. 3 shows a first signal pattern.

The locating audio signal burst of FIG. 2 is intended to allow location of the sound generator by a listener, e.g. the siren, emitting a sound in accordance with the audio signal burst of FIG. 3.

It has been found experimentally that a human listener may more easily locate a broadband noise sound signal than a monotone or polytone signal comprising a few frequencies. The human brain is capable of distinguishing the direction from which a broadband sound, e.g. white noise sound emits, taking account of reflections from obstacles, etc. and background noise.

Referring to FIG. 3, there is shown a first audio signal pattern. The first audio signal pattern comprises an alerting phase 30, comprising a plurality of successive alert pulses 31, 32, 33, the alert pulses repeated one after each other, with a 10 ms silence between the finish of a preceding alert pulse and commencement of a successive alert pulse; and a localizing phase 40 in which a localizing audio signal burst 34 is provided. At the end of the alerting phase, a 50 ms silence is provided before commencement of the locating phase. The duration of the localizing audio signal burst 34 is predetermined, and may be in the range 100 ms to 400 ms and optimally, around 200 ms. The localizing signal burst 34 is separated by the silent period of 50 ms, from the preceding alert signal burst 33.

After the localizing signal burst 34 there is a 50 ms silence at the end of the localizing phase 40 prior to repeating the alerting phase 30 of a subsequent signal pattern.

It is found experimentally that by repeating an alert sound burst three times, with a slight delay between bursts, and then, after a further delay consulting a locating sound burst, a human listener is placed in an attentive state by the alert sounds and then locates the direction from which the sounds are coming, by hearing the locating sound.

The alert signal bursts 31, 32, 33 in the alerting phase 30 may each comprise respective fundamental, first, second and third main frequency components $F_F$, F1, F2, F3. Each of the main frequency components may be present in the alert pulse in varying amplitude proportions.

For example another second alert signal burst is described in Table 2 of the accompanying tables. The second alert signal burst comprises a fundamental frequency component F1 commencing at 600 Hz and rising over a 500 Hz frequency sweep, to 1100 Hz.

In the second signal alert burst as described in Table 2, there are present four frequency components comprising a fundamental, and first, second, and third harmonics of the fundamental. As the fundamental sweeps in frequency over the duration of the alert pulse, the first, second, and third harmonics similarly sweep in harmonic relation to the fundamental.

In the second alert signal burst, the fundamental frequency $F_0$ which sweeps over the duration of the alert pulse at a start frequency of 600 Hz, over a 500 Hz range to 1100 Hz. The first main frequency F1 element sweeps between 1200 Hz and 2200 Hz over the duration of the alert signal burst. The second main frequency element F2 sweeps between 1800 Hz and 3300 Hz over the duration of the alert signal burst. The third main frequency component F3 sweeps from a start frequency of 2400 Hz to a finish frequency of 4400 Hz over the duration of the alert signal burst.

Respective third and fourth alert signal bursts are described in Tables 3 and 4 of the accompanying tables. Each of the third or fourth alert pulses may be repeated in the alerting phase of a sound pattern, with 10 ms silent periods between successive alert signal burst, and with a 50 ms silence between the end of the final alert signal burst and the commencement of the locating signal burst 34.

Referring to Table 3, the third alert signal burst comprises a fundamental frequency component of 400 Hz carrier frequency, which travels over a 500 Hz frequency sweep to raise to 900 Hz at the end of the 100 ms duration of the alert signal burst.

There may be provided first, second and third main frequency components F1, F2, F3 respectively which in the third alert pulse are present in equal amplitude to each other.

The fourth alert signal burst as described in Table 4, comprises a first frequency component F1 of 600 Hz, modulated by 500 Hz sweep to raise to 1100 Hz over the 100 ms duration of the signal burst. A first main frequency component F1 sweeps in the range 1200 Hz to 2200 Hz, a second main frequency component F2 sweeps in the range 1800 Hz to 3300 Hz, and a third main frequency component F3 sweeps in the range 2400 Hz to 4400 Hz. The fundamental and first to third main frequency components are present in equal amplitude proportion, i.e. in the proportion $F_F$ F1:F2:F3=0 dB:0 dB:0 dB:0 dB.

The fundamental, the first second and third main frequency components $F_F$, F1, F2, F3 respectively may be present in the ratio $F_F$:F1:F2:F3:=0 dB:−3 dB:−6 dB:9 dB.

Referring to Table 8, an eighth alert signal burst which may be used in alerting phase 30, comprises a main fundamental frequency component $F_F$ swept from 600 Hz to 1100 Hz over the 100 ms duration of the alert signal burst 30; a first main frequency component F1 comprising a swept frequency signal beginning at 800 Hz and swept to 1467 Hz over the duration of the alert signal burst 30; a second main frequency component F2, commencing at 1000 Hz and swept to 1833 Hz over the duration of the alert signal burst 30, and a third main frequency component F3, beginning at 1200 Hz and swept upwardly in frequency to 2200 Hz over the duration of the alert signal burst 30. The main frequency components $F_F$, F1, F2, and F3 are present in the eighth alert signal burst of Table 8 in the ratio as follows; 0 dB:0 dB:0 dB:0 dB i.e. present in equal amplitude proportions to each other.

In the eighth alert signal burst of Table 8, the first second and third main frequencies do not lie on harmonics of the fundamental frequency. The ratio of FF, F1, F2 and F3 is maintained at approximately 1:1.33:1.666:2.0 throughout the frequency sweep and throughout the duration of the alert signal burst.

Further examples of alert signal burst are described in Tables 1 and 5 to 7 of the accompanying tables.

The sound pattern of FIG. 3 is fed to a sound generating means, e.g. a siren to produce a sound which is played through the siren of, for example, an emergency vehicle and which has substantially the same frequency characteristics as the sound pattern of FIG. 3.

In experimental tests, the signal of FIG. 3 was supplied to a broad range speaker, and the output of the speaker measured using an SPL meter. The speaker running at 2,400 revs per minute produced a 63 dB(A) rms signal, having a 77 dBa peak. The signal of FIG. 3 was measured at 52–64 dB(A) rms, (69–77.5 dB (A) peak).

Under experimental conditions, eight broad range speakers were used and were found to produce peak signals to within ±3 dB(A) of each other. The signals were measured against a background of white noise to test their audibility against the white noise background.

Figure 4:
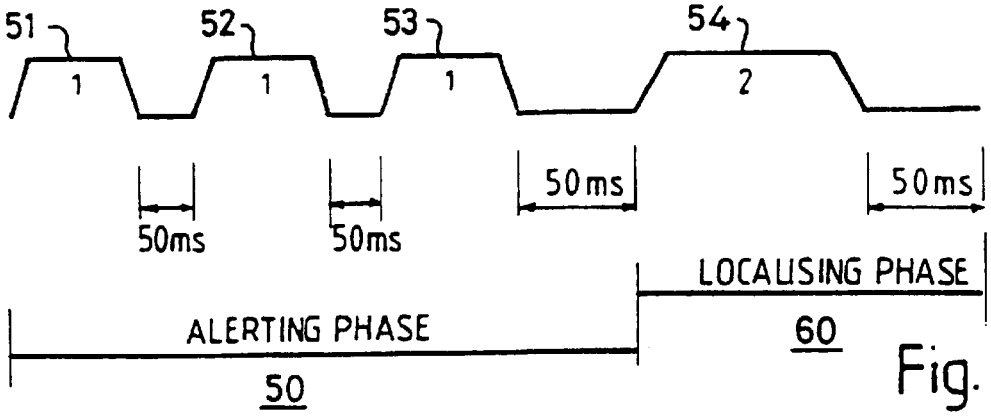
FIG. 4 shows a second signal pattern.
Figure 5:
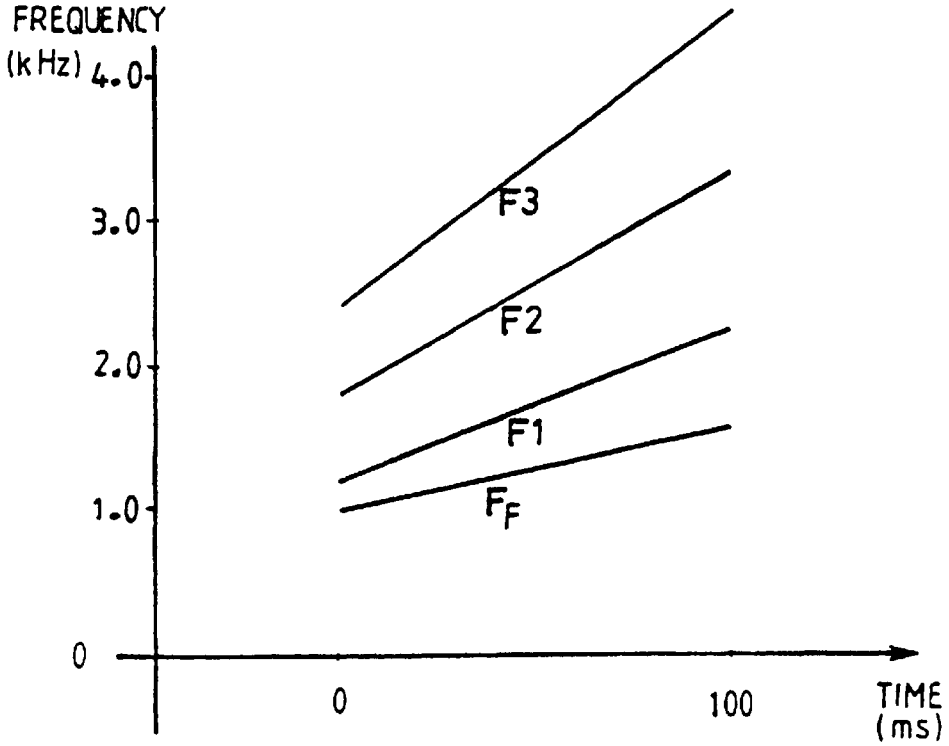
FIG. 5 describes in chart form the second alert signal burst of Table 2.

Referring to FIG. 4, there is shown a second signal pattern comprising an alerting phase 50, the alerting phase comprising a series of alert signal bursts 51–53 played sequentially, with 50 ms silences between successive alert signal bursts, followed by a 50 ms silence at the end of the alerting phase; and a localizing phase 60 comprising one or a plurality of localizing signal bursts 54 played in series and separated by each other by a 50 ms silence.

Any one or more, or any combination of the aforementioned signal patterns may be feed through a sound generating means in any of the devices for which the invention has application. For example the sound pattern may be feed to an alarm, an aid, or an earcon or indeed or any other device where location of an object in an alerting situation is important.

Although the invention has been described by reference to a single sound generating means the invention also comprises a system where a plurality of sound generating means are provided and either first and second sound generating means are adapted to emit first and second sounds i.e. locating sounds and alerting sounds respectively; or alternatively a system where a plurality of sound generating means are adapted to emit both said first and second sounds in a controlled manner so that the nature and duration of said sounds can be predetermined and the interaction of each of one or more of said devices may be controlled so as to provide for a preselected sound pattern which represents the totality of the sound emitted from all or selected ones of said devices.

In the instance where the invention is to be used in relation to a fixed structure such as a building the locating sound may comprise bursts of locating noise wherein the interval between each of said bursts successively diminishes and/or the length of each burst of locating noise successively diminishes thus providing for a noise pattern of quickening sound or continuity.

The invention thus provides for a sound device having the following advantageous properties:

(i) The sound is relatively unaffected by reflections or echoes of the sound from buildings etc.

(ii) The sound allows a person hearing the sound to estimate the distance of the object from which the sound emanates.

(iii) In the instance where the invention is embodied in a vehicle siren the identification of vehicle speed, vehicle type, vehicle location is possible.

(iv) The sound can be adapted so as to be easily distinguishable from fire alarms, car alarms, or burglar alarms in the vicinity of the vehicle.

(v) The sound is easily distinguished from and stands out from general background noise, street noise, passing aircraft etc.

(vi) The sound enables a person hearing the sound, to estimate the direction relative to the person from which the sound is coming from.

(vii) The sound immediately alerts a person who hears the sound.

(viii) The sound may enable a person hearing the sound to identify the particular type of vehicle, e.g. police car, ambulance, fire engine to which the sound relates.

(ix) In the instance where the invention is embodied in a device or system for location in a building, the sound enables the person hearing the sound to navigate safe route of entry/exit.

(x) In the instance where the invention is embodied in a burglar alarm the sound enables the person hearing the sound to detect the location of the alarm and thus the burgled site.

(xi) In the instance where the invention is embodied in an aid for the visually handicapped the sound enables the person hearing the sound to navigate.

(xii) In the instance where the device includes or is associated with a camera or recorder the device ensures that a suitable image of an intruder is recorded.

Other advantageous properties of the invention will be apparent to those skilled in the art and to those who have experience of the invention.

TABLE 1

| | |
|---|---|
| Burst 50 | F1 400 Hz with 500 Hz sweep. |
| (type 2) | 10 mS interpulse gap alerting phase. 50 mS alerting - locating |
| | F1 400 Hz ~ 900 Hz @ 0 dB |
| | F2 800 Hz ~ 1800 Hz @ −3 dB |
| | F3 1200 Hz ~ 2700 Hz @ −6 dB |
| | F4 1600 Hz ~ 3600 Hz @ −9 dB |
| | F5 2000 Hz ~ 4500 Hz @ −12 db |
| | Where F1 is the fundamental frequency |

TABLE 2

| | |
|---|---|
| Burst 51 | F1 600 Hz, 500 Hz sweep. |
| (type 1) | 10 mS interpulse gap alerting phase. 50 mS alerting - locating |

TABLE 2-continued

| | |
|---|---|
| | F1 600 Hz ~ 1100 Hz @ 0 dB<br>F2 1200 Hz ~ 2200 Hz @ 0 dB<br>F3 1800 Hz ~ 3300 Hz @ 0 dB<br>F4 2400 Hz ~ 4400 Hz @ 0 dB<br>Where F1 is the fundamental frequency |

TABLE 3

| | |
|---|---|
| Burst 52<br>(type 1) | F1 400 Hz, 500 Hz sweep.<br>10 mS interpulse gap alerting phase. 50 mS alerting - locating<br>F1 400 Hz ~ 900 Hz @ 0 dB<br>F2 800 Hz ~ 1800 Hz @ 0 dB<br>F3 1200 Hz ~ 2700 Hz @ 0 dB<br>F4 1600 Hz ~ 3600 Hz @ 0 dB<br>Where F1 is the fundamental frequency |

TABLE 4

| | |
|---|---|
| Burst 53<br>(type 1) | F1 600 Hz, 500 Hz sweep.<br>10 mS interpulse gap alerting phase. 50 mS alerting - locating<br>F1 600 Hz ~ 1100 Hz @ 0 dB<br>F2 1200 Hz ~ 2200 Hz @ −3 dB<br>F3 1800 Hz ~ 3300 Hz @ −6 dB<br>F4 2400 Hz ~ 4400 Hz @ −9 dB<br>Where F1 is the fundamental frequency |

TABLE 5

| | |
|---|---|
| Burst 42A<br>(type 2) | F1 600 Hz, 500 Hz sweep. 50 mS interpulse gap.<br>F1 600 Hz ~ 1100 Hz @ 0 dB<br>F2 1200 Hz ~ 2200 Hz @ −3 db<br>F3 1800 Hz ~ 3300 Hz @ −6 dB<br>F4 2400 Hz ~ 4400 Hz @ −9 dB |

TABLE 6

| | |
|---|---|
| Burst 42BC<br>(type 2) | F1 600 Hz with 500 Hz sweep. 50 mS interpulse gap.<br>F1 600 Hz ~ 1100 Hz @ 0 dB<br>F2 1200 Hz ~ 2200 Hz @ 0 dB<br>F3 1800 Hz ~ 3300 Hz @ 0 dB<br>F4 2400 Hz ~ 4400 Hz @ 0 dB |

TABLE 7

| | |
|---|---|
| Burst 46<br>(type 2) | INHARMONIC. 50 mS interpulse gap, equal amplitude.<br>F1 600 Hz swept to ..1100 HZ, Fa 900 Hz swept to 1650 Hz<br>Fb 1200 HZ swept to 2200 Hz, Fc 1500 Hz swept to 2750 Hz |

TABLE 8

| | |
|---|---|
| Burst 47<br>(type 1) | INHARMONIC. 50 mS interpulse gap, equal amplitude.<br>F1 600 Hz swept to 1100 Hz @ 0 dB<br>Fa 800 Hz swept to 1467 Hz @ 0 dB<br>Fb 1000 Hz swept to 1833 Hz @ 0 dB<br>Fc 1200 Hz swept to 2200 Hz @ 0 dB |

What is claimed is:

1. A directing and alerting device which is adapted to emit either simultaneously or successively a locating sound comprising broad band noise formed from frequencies emitted simultaneously and falling within a human hearing range between 40 Hz and 20 kHz; and an alerting sound comprising at least one frequency within the human hearing range.

2. A device according to claim 1 wherein said locating sound comprises white noise or a flat random noise.

3. A device according to claim 1 wherein said locating sound comprises at lease one selected frequency which is either amplified or attenuated..

4. A device according to claim 1 wherein said locating and alerting sounds are emitted successively.

5. A device according to claim 4 wherein there is a predetermined interval between said emissions.

6. A device according to claim 1 wherein said alerting sound comprises a plurality of bursts of sound.

7. A device according to claim 6 wherein the interval between said bursts is predetermined.

8. A device according to claim 6 wherein the interval between said bursts of alerting sound and said locating sound is predetermined.

9. A device according to claim 6 wherein at least one of said bursts comprises a main fundamental frequency.

10. A device according to claim 9 wherein said fundamental frequency sweeps over a frequency range.

11. A device according to claim 6 wherein at least two of said bursts are of different frequency.

12. A device according to claim 1 wherein said alerting sound is emitted prior to said locating sound.

13. A device according to claim 1 wherein said alerting sound is emitted after said locating sound.

14. A device according to claim 1 wherein said alerting sound comprises at least two distinctive components.

15. A device according to claim 1 wherein said alerting sound is ramped.

16. A device according to claim 1 further comprising a cut-out means which after a preselected interval of time disables or cuts-out at least the locating sound.

17. A device according to claim 1 further comprising a cut-out means which following selective activation disables or cuts-out at least the alerting sound.

18. A device according to claim 1 wherein said device further includes or is associated with a camera or a records.

19. A device according to claim 1 wherein said device further comprises at least first and second devices each adapted to emit at least either the locating or the alerting sound, and further wherein said device comprises a control means for coordinating the emission of said locating and/or alerting sounds either simultaneously or successively.

20. A device according to claim 1 wherein said device is provided with amplification and/or attenuation means for selectively amplifying or attenuating at least one frequency component of said locating sound.

21. A device according to claim 1 comprising a signal generating means for generating a locating sound or a locating sound and an alerting sound.

22. A device according to claim 1 comprising a signal storage means in which there is stored an audio signal comprising a locating sound or a locating sound and an alerting sound.

23. A device which is adapted to emit a locating sound comprising broad band noise formed from frequencies emitted simultaneously and falling within a human hearing range between 40 Hz and 20 kHz.

24. A device according to claim 23 wherein said broad band noise is emitted for a time period between 10 ms and 2 secs.

25. A device according to claim 23 wherein the broad band noise is ramped.

26. A device according to any one of claims 23, 24, or 25 wherein broad band noise in a range between 40 Hz and 20 kHz is provided.

27. A device according to claim 23 wherein broad band noise in a range between 40 Hz to 16 kHz is provided.

28. A device comprising signal generating means comprising means for generating a locating sound comprising a burst of broad band noise covering a majority of frequencies emitted simultaneously in the human hearing range within 40 Hz and 20 kHz.

29. A device comprising signal generating means according to claim 28 wherein said means generate frequencies comprising said broad band noise simultaneously.

30. A device comprising signal storage means in which there is stored an audio signal comprising a locating sound comprising a burst of broad band noise covering a majority of frequencies emitted simultaneously in the human hearing range within 40 Hz and 20 kHz.

* * * * *

US006201470C1

(12) EX PARTE REEXAMINATION CERTIFICATE (10761st)

United States Patent

Withington

(10) Number: US 6,201,470 C1

(45) Certificate Issued: Nov. 10, 2015

(54) LOCATING DEVICES

(75) Inventor: Deborah Jane Withington, Harrogate (GB)

(73) Assignee: BRIGADE (BBS-TEK) LIMITED, South Darenth, Kent (GB)

Reexamination Request:
No. 90/013,164, Feb. 25, 2014

Reexamination Certificate for:

| | |
|---|---|
| Patent No.: | **6,201,470** |
| Issued: | **Mar. 13, 2001** |
| Appl. No.: | **08/983,276** |
| PCT Filed: | **Jun. 17, 1996** |
| PCT No.: | **PCT/GB96/01420** |
| § 371 (c)(1), (2), (4) Date: | **Jan. 7, 1998** |
| PCT Pub. No.: | **WO97/03424** |
| PCT Pub. Date: | **Jan. 30, 1997** |

(30) Foreign Application Priority Data

Jul. 7, 1995 (GB) ..... 9513887
Oct. 17, 1995 (GB) ..... 9521203

(51) Int. Cl.

| | |
|---|---|
| ***G08B 3/00*** | (2006.01) |
| ***G08B 3/10*** | (2006.01) |
| *G08B 7/06* | (2006.01) |

(52) U.S. Cl.
CPC .. *G08B 3/10* (2013.01); *G08B 7/062* (2013.01)

(58) Field of Classification Search
None
See application file for complete search history.

(56) References Cited

To view the complete listing of prior art documents cited during the proceeding for Reexamination Control Number 90/013,164, please refer to the USPTO's public Patent Application Information Retrieval (PAIR) system under the Display References tab.

*Primary Examiner* — Deandra Hughes

(57) ABSTRACT

A device usable in a plurality of environments such as in building, transport vehicles, pedestrian aids and sirens for producing a locating sound of broad band noise. The broad band noise is formed from frequencies emitted simultaneously within a human hearing range. An alerting sound may also be emitted.

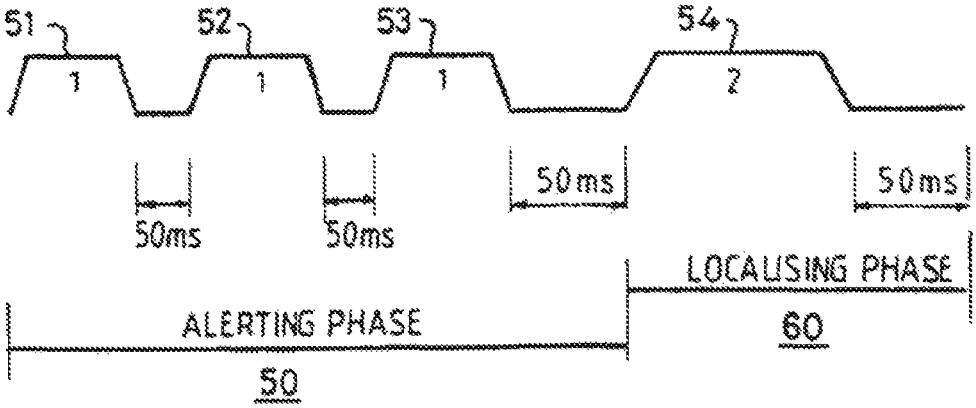

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 23-30 are cancelled.

Claims 1-22 were not reexamined.

* * * * *